United States Patent [19]

Dreissigacker et al.

[11] 4,015,759

[45] Apr. 5, 1977

[54] BACKPACK FRAME HAVING SHOULDER AND HIP SUPPORTS WITH FLEXIBLE CONNECTION TO HIP SUPPORT

[76] Inventors: Peter D. Dreissigacker; Richard A. Dreissigacker, both of 4224 El Camino Real, Palo Alto, Calif. 94306

[22] Filed: May 27, 1975

[21] Appl. No.: 580,557

[52] U.S. Cl. ..... 224/25 A; 224/8 R

[51] Int. Cl.[2] ..... A45F 3/10

[58] Field of Search ..... 224/25 A, 8 R; 128/78; 3/1.91, 1.911; 403/114, 115; 64/15 B

[56] References Cited

UNITED STATES PATENTS

| | | | |
|---|---|---|---|
| 1,650,650 | 11/1927 | Pieper | 128/78 |
| 3,355,075 | 11/1967 | Dean | 224/25 A |
| 3,774,824 | 11/1973 | Hansson et al. | 224/25 A X |
| 3,889,859 | 6/1975 | Joseph | 224/25 A X |

FOREIGN PATENTS OR APPLICATIONS

| | | | |
|---|---|---|---|
| 76,243 | 2/1950 | Norway | 224/8 R |
| 86,796 | 1/1956 | Norway | 224/8 R |
| 764,880 | 1/1957 | United Kingdom | 224/8 R |

*Primary Examiner*—Albert J. Makay
*Assistant Examiner*—Randolph A. Reese
*Attorney, Agent, or Firm*—Julian Caplan

[57] ABSTRACT

The frame to which a backpack is fastened is formed of tubing bent in hourglass shape in rear elevation and two inward offsets in side elevation. A horizontal rigidifying cross bar extends through about the middle of the top part of the hourglass and is adjustable at different elevations. The upper end of a connector is fixed to the narrow part of the frame at adjustable elevations. The lower end of the connector is fixed to a hip level belt stretcher. The connector is constructed with generally vertical ribs which are wide in a front-rear sense and thin in side-to-side sense so that the connector flexes about the Y and Z axes passing through the narrowest part of the connector, which is positioned close to the point of the spine of the wearer, where there is little or no bending of the spine during bending or twisting of the torso, but is rigid against flexing about the X axis. A hip belt encircling the hips of the wearer is connected to the belt stretcher at the lower end of the connector. The tops of shoulder straps are adjustably connected to the cross bar and the lower ends to the lower part of the frame. The pack weight is distributed between shoulders and hips. Natural movements of shoulders and hips are not inhibited.

15 Claims, 12 Drawing Figures

BACKPACK FRAME HAVING SHOULDER AND HIP SUPPORTS WITH FLEXIBLE CONNECTION TO HIP SUPPORT

This invention relates to a new and improved backpack frame having shoulder and hip supports with a flexible connection between the frame and the hip support. The frame and its supports permit the user to carry heavy loads but allow freedom of normal body movement. Thus the present invention permits relative movement between the shoulders and upper back of the wearer on one hand and between the upper back and the hips of the wearer on the other hand.

The frame of the present invention is secured to the shoulders of the wearer by shoulder straps and is connected by means of a connector to a hip belt. The connector permits flexible movement about two but not three axes which coincide at a locus of the spine which has least bending as the wearer moves his torso with normal bending or twisting movements. Thus, although freedom of movement is permitted, nevertheless, the frame does not have a forward-backward movement and the connector does not flex about a horizontal transverse axis through said locus.

The fact that the present invention permits relative movement between the shoulders and upper back and hips of the wearer reduces fatigue from carrying heavy loads.

Another feature of the invention is that a part of the weight of the pack is carried by the shoulders and a part by the hips, again reducing fatigue.

The frame of the present invention is relatively nonflexible and is formed of tubing bent in a generally hourglass shape with a cross bar at or slightly above the shoulder level. The hourglass shape permits the elbows to swing freely without contacting the frame and eliminates some of the cross bars of conventional pack frame, thereby reducing the weight of the frame.

Another feature of the invention is the adjustability of the frame. Thus the connector between the frame and the hip belt may be moved vertically upward and downward. Similarly, the cross bar to which the upper ends of the shoulder straps are attached may be moved vertically upward-downward. Further, the point of attachment of the upper ends of the shoulder straps may be moved horizontally inwardly and outwardly. These features of adjustability permit adjustment for the size of the wearer and particularly the distance between the shoulders and hips. Further, the invention permits the adjustment of the center of gravity of the pack relative to the center of gravity of the wearer. The latter adjustment is important where the terrain varies. Thus, the pack may be carried high or low on the back as desired for comfort and stability.

A further feature of the invention is the construction of a connector between the metal portion of the frame and the hip belt. At its narrowest point, said connector comprises inwardly curved substantially vertical forward-rearward extending side walls which are considerably thinner than their forward-rearward dimension and preferably there is a gap between said side walls and a vertical straight inner wall. Between the side walls and the inner wall are soft elastic cores which separate the partitions but make it possible for the partitions to flex. The narrowest portion of the connector at the midpoint of the thickness thereof is the location where a horizontal transverse X axis, a vertical Y axis and a horizontal longitudinal Z axis intersect. As has previously been mentioned, when the pack is on the frame and the frame is strapped to the body the axis-intersection point of the connector is closely adjacent to the point of the spine which does not flex despite bending and twisting movements of the shoulders relative to the hip. The connector permits flexure about the Y and Z axes, the soft elastic core allowing the thin-wall webs to move relative to each other while preventing a total collapse of said thin-wall webs and maintaining a geometry which is generally similar to the connector at rest. Further, the connector has the ability to withstand substantial compressive loads without buckling. The soft elastic core functions as a support or restraining force which aids in maintaining the original geometry of the thin-wall webs even if the loading is off center. Another feature of the construction of the connector is its ability to resist any rotation about the X axis. This results from a combination of the relationship of the thinness of the ribs to their front-rear dimension and the effect of the soft elastic core acting to retain the original geometry of the thin walled members.

Another feature of the invention is the construction of the belt stretcher which is either integral with or connected to the connector. Said stretcher is concave and is sufficiently flexible so that it places the hip-engaging belt under continuous tension but accommodates the shape of the back of the wearer when the hip-engaging belt is tightened. The belt is attached to the outer ends of the stretcher and encircles the torso near the hips. The belt is padded for comfort. The stretcher does not engage the wearer's back.

Other objects of the present invention will become apparent upon reading the following specification and referring to the accompanying drawings in which similar characters of reference represent corresponding parts in each of the several views.

Figure 1:
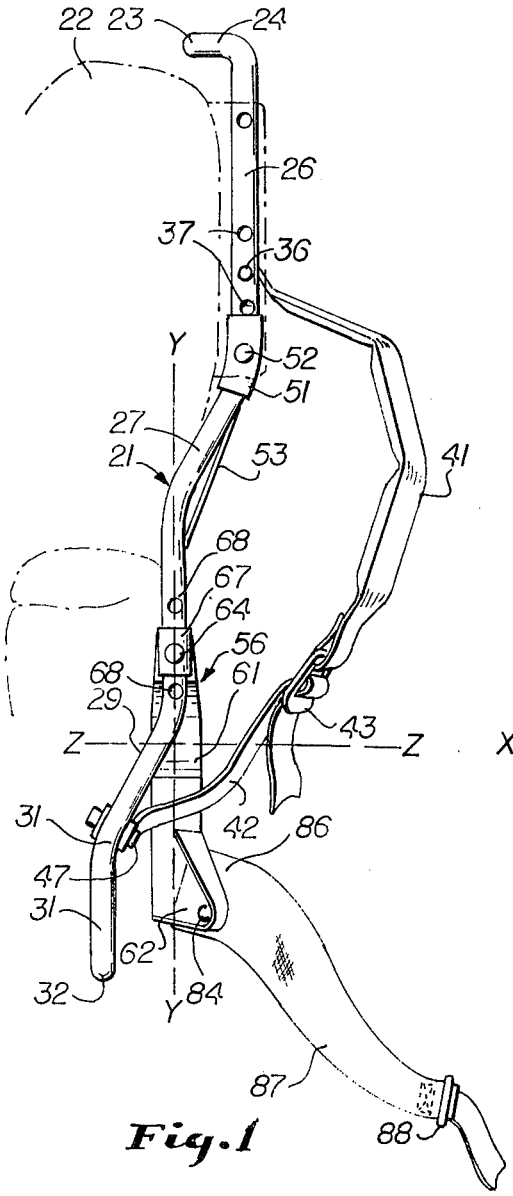
FIG. 1 is a side elevational view of the frame.
Figure 2:
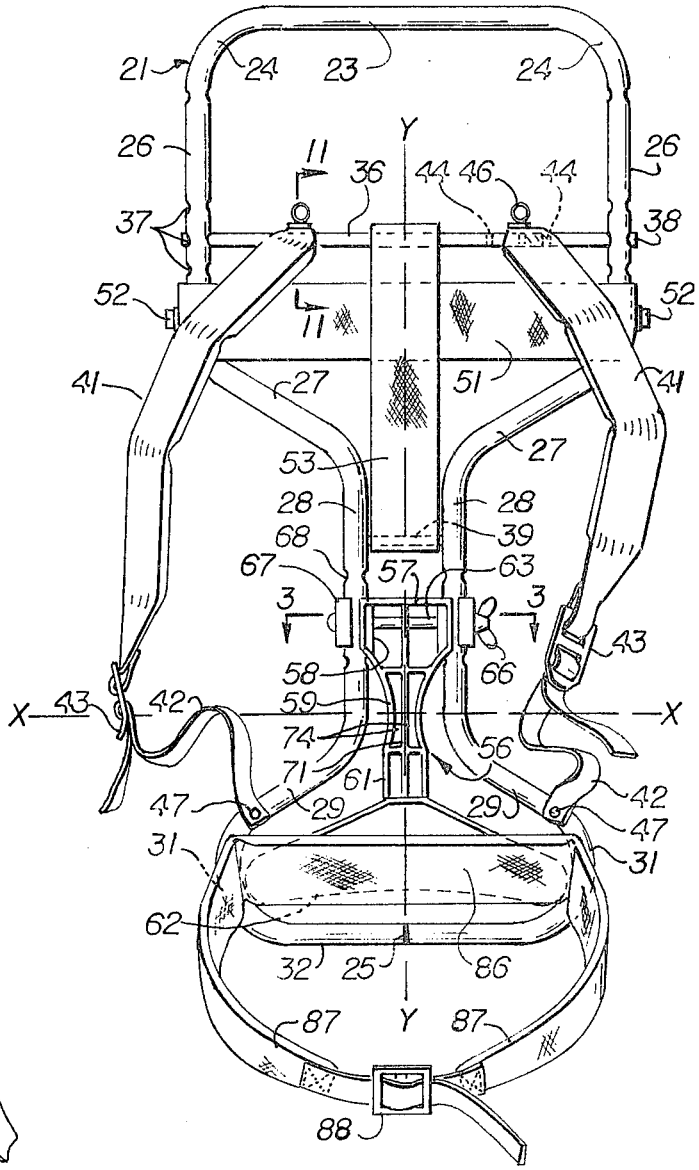
FIG. 2 is a front elevational view thereof.
Figure 4:
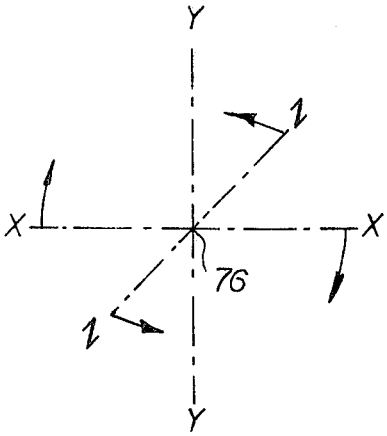
FIG. 4 is a schematic perspective view showing the three axes passing through the nodal point of the connector.
Figure 11:
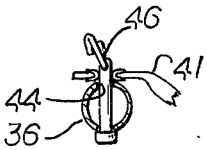
FIG. 11 is a fragmentary sectional view taken substantially along the line 11—11 of FIG. 2.
Figure 5:
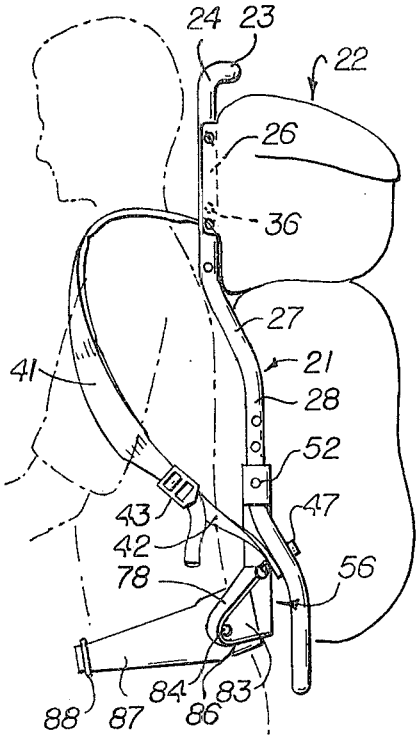
FIG. 5 is a side elevational view in reduced scale showing the frame and a pack attached thereto in position of wear.

The present invention employs a rigid frame 21 formed of metal tubing and preferably having a single joint 25 and having an hourglass shape when viewed in front or rear elevation. A pack 22 which may be of any shape is connected to the frame 21 by means not shown and subject to considerable variation. The tubing which forms the frame 21 has a top horizontal member 23 which in the installed position of FIG. 5 is preferably behind the back of the head and is forwardly curved and bent in relatively large radius 90° curves 24 which join the top vertical sides 26 extending down to about the point where the back and shoulders of the wearer join. Below the top vertical stretches 26 are inwardly-rearwardly angled stretches 27 which terminate in substantially vertical waist sections 28. At the lower end of sections 28 are outwardly-rearwardly curved stretches 29 which terminate in bottom bends 31 which are connected together by bottom horizontal member 32 in the middle of which is the joint 25. Observing FIG. 1, it will be seen that the top horizontal member 23 is offset rearwardly relative to top vertical stretches 26 and that the vertical waist sections 28 are offset rearwardly relative to stretches 26. Bottom bends and horizontal member 32 likewise are offset rearwardly. As is best shown in FIG. 5, the shape heretofore described insures that the lower portion of the frame 21 is offset sufficiently rearwardly to accommodate the hips of the wearer and to permit easy strides. The narrow waist of the hourglass frame permits the elbows of the wearer to swing freely without contacting the frame.

To rigidify frame 21 and also to provide a means of attachment of the straps and webbbing as hereinafter set forth, a horizontal transverse top cross bar 36 is provided which attaches to one of a vertically spaced apart series of holes 37 formed in top vertical stretch 26 and is held in place by an attachment 38. Thus the cross bar (and the top attachment for the shoulder strap) may be adjusted vertically depending upon the height of the wearer. Bottom cross bar 39 extends between stretches 28 and is preferably fixed in position.

Upper shoulder strap 41 is fastened to top cross bar 36 and for such purpose the latter is provided with a plurality of horizontally spaced apart holes 44 to which said upper shoulder strap 41 is attached by attachment means 46. Lower shoulder strap portion 42 is connected to upper portion 41 by an adjustable buckle 43 so that the length of the straps 41, 42 may be adjusted for the size of the wearer. Lower shoulder strap 42 is attached to portions 29 adjacent their outer end. As shown in FIG. 5, the shoulder strap extends from top cross bar 36 up to the top of the shoulders of the wearer, forwardly, under the arms and outwardly rearwardly to the point of attachment 47. Thus a portion of the weight of the pack 22 may be carried by the shoulders of the wearer.

Horizontal transverse webbing 51 extends around and between the lower ends of top vertical stretches 26 and applies part of the weight of the pack to the back of the shoulders and upper back of the wearer. Webbing 51 is held in place by attachments 52 threaded into the tubing of the frame or lashed to the tubing of the frame. Extending vertically between top cross bar 36 and bottom cross bar 39 is vertical webbing 53 which holds the pack 22 rearward of the frame 21.

Figure 3:
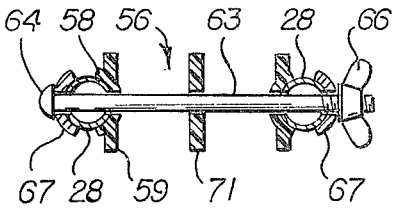
FIG. 3 is a fragmentary sectional view taken substantially along the line 3—3 of FIG. 2.

An important feature of the invention is the construction of connector 56 which transmits part of the weight carried by the frame 21 downward to the hips of the wearer. In the form of the invention shown in FIGS. 1–6, connector 56 has a top transverse member 57 which extends between the stretches 28 and assists in spacing them apart. The forward-rearward horizontal dimension of member 57, as well as the other members of the connector 56 hereinafter described, comprises what is termed herein the "thickness" of member 57 as distinguished from the wall thickness thereof. Below top 57 are sides 58 formed as cylindrical sections to engage the tubing of stretches 28 and below the clamp portions 58 are concave sides 59 which terminate in vertical downward extensions 61 connected to bottom belt stretcher 62, hereinafter described. The horizontal transverse pin 63 has its head 64 on the outside of one outer clamp member 67 which likewise is a section of a cylinder and fits against the outside of tubing 28 opposite inner clamp member 58. On the side of connector 56 opposite head 64 the pin 63 is threaded and provided with a nut 66 which bears against the clamp member 67 on the opposite side of the frame. As is best shown in FIG. 3, the clamp structure heretofore described insures that the connector 56 at its upper end is rigid relative to frame members 28. Pin 63 fits through any of vertically spaced apart holes 68 in stretches 28. This permits vertical adjustment of the upper end of connector 56 depending partially on the size of the wearer and partially on the desired weight distribution.

Figure 6:
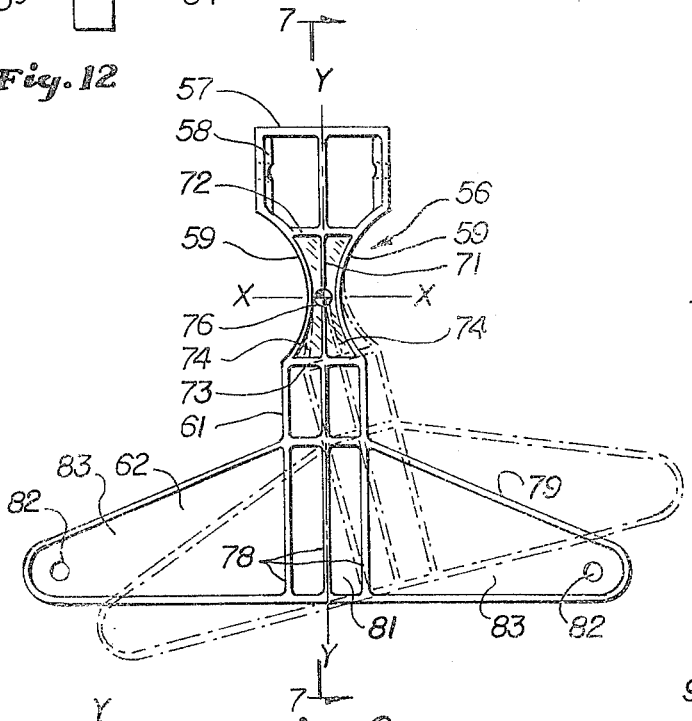
FIG. 6 is an enlarged front elevational view of the connector and its plate.
Figure 7:
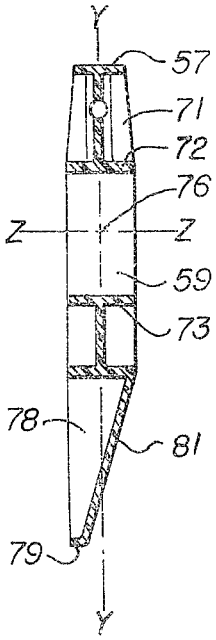
FIG. 7 is a vertical sectional view taken substantially along the line 7—7 of FIG. 6.

Referring now to FIGS. 6 and 7, the sides 59 are thin in wall thickness relative to their total thickness and midway between the concave sides 59 is a vertical center rib 71 which likewise is thin in wall thickness. The spaces between top transverse rib 72 and bottom transverse rib 73 which define the narrow waist of the connector 56 are filled with soft rubber or an elastomeric plastic 74. The rubber filling 74 permits flexure of connector 56 about the Y and Z axes as defined in FIG. 4 with axis intersection point 76 being located at the narrow waist of the connector approximately midway of the thickness of rib 71. Flexure about the Y axis permits one end of the stretcher 62 to move forwardly while the other end of the stretcher 62 moves rearwardly. Flexure about the Z axis permits the stretcher 62 to move from the solid line position of FIG. 6 to the dot-and-dash position and a combination of the movements about the Y and Z axes permits a simultaneous twisting and bending of the narrow waist of the connector 56 about the axis intersection point 76. The rubber filling 74 permits the narrow ribs and sides to bend without collapsing and restores the walls to initial position when the bending stresses are relaxed. Flexure about the X axis is prevented by the construction of the connector 56 in that the wall thicknesses are quite thin but the overall thickness from front to rear is considerably greater, and hence bending is restrained.

Stretcher 62 in the form of the invention shown in FIGS. 1–9 is generally trapezoidal with rounded outer corner wings 83. Thus the width as viewed in FIG. 2 of the upper end of member 62 is narrow, angling downwardly-outwardly from the lower end of connector 56 and the bottom edge of member 62 is substantially horizontal. The stretcher 62 is rigidified by means of vertical central ribs 78 and the stretcher 62 is further rigidified by peripheral ribs 79. The back 81 of stretcher 62 slants forwardly-downwardly. Attachment holes 82 are formed near the outer ends of the outer wings 83 of the stretcher.

Figure 12:
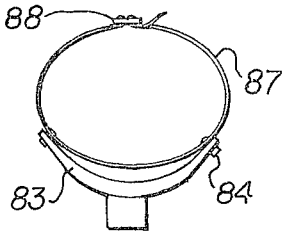
FIG. 12 is a somewhat schematic top plan view showing the belt stretcher and belt.

The hip belt consists of a padded back portion 86 which is substantially rectangular in shape and is attached to the holes 82 by attachment means 84. Although the ribs 78, 79 rigidify stretcher 62, nevertheless, the plate may flex to apply tension to belt portion 86 to keep the belt taut and keep stretcher 62 away from the back of the wearer. (See especially FIG. 12). Attached to either end of back portion 86 are straps 87 which come around the torso of the wearer and are preferably joined together by a front buckle 88. Thus a portion of the weight of the pack 22 is transmitted by the connector 56 down to the belt and on to the hips.

In the form of the invention, as shown in FIGS. 6 and 7, the upper portion of connector 56 and the stretcher 62 are integral and are preferably molded of a plastic material such as nylon.

Figure 10:
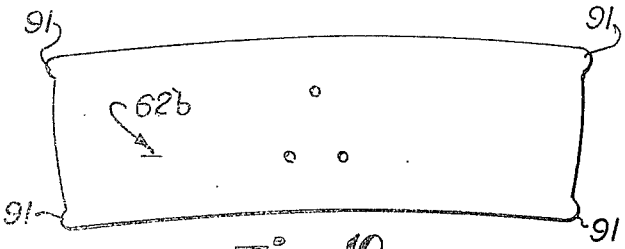
FIG. 10 is a front elevational view of a modified plate which may be used with the structure either of FIG. 6 or FIG. 8.

Instead of the trapezoidal shape of the stretch 62 of FIG. 6, a rectangular stretch **62*b*, as shown in FIG. 10, may be substituted. Knobs 91 may be formed at each corner of stretcher 62*b* to assist in locating the back of the belt relative to the stretcher. Although not shown in FIG. 10, the stretcher 62*b*** may be thicker and only sufficiently flexible to permit the belt to accommodate the curvature of the back of the wearer.

Figure 9:
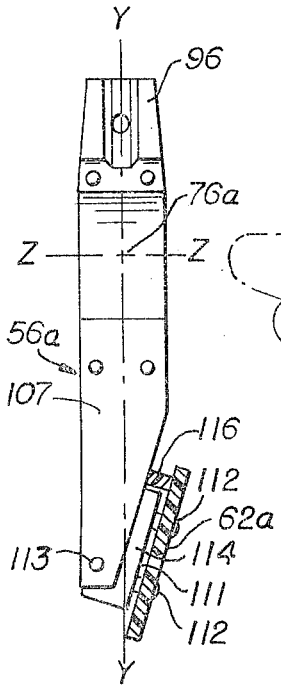
FIG. 9 is a sectional view taken substantially along the line 9—9 of FIG. 8.
Figure 8:
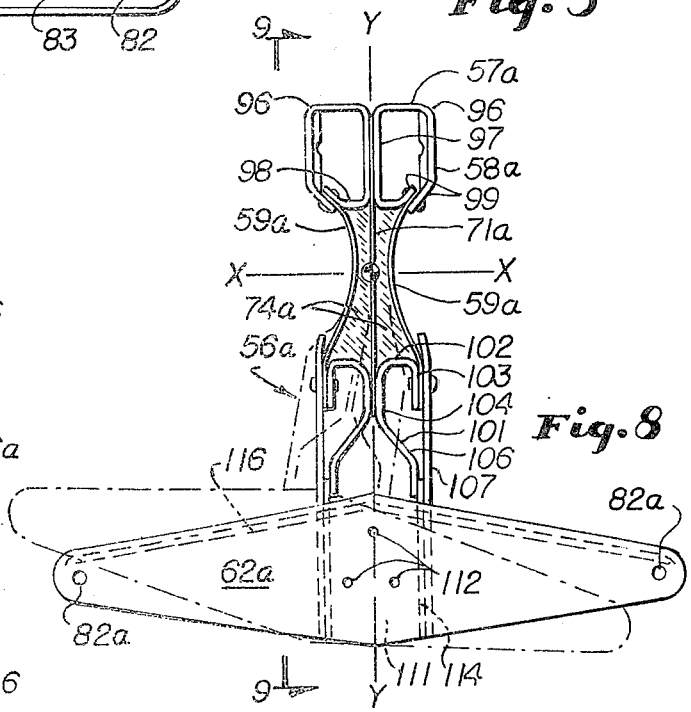
FIG. 8 is a view similar to FIG. 6 of a modified connector.

In the form of the invention shown in FIGS. 8 and 9, the upper portion of the connector **56*a* is formed of metal and is separate from the stretcher 62*a* but rigidly secured thereto. Two top eyes 96 are formed in connector 56*a* by multiple bends of the metal strap of which they are comprised. Thus, each eye 96 has a top 57*a*, a vertical downward central stretch 97, an outward bent stretch 98, which is formed with an outward-upward bend 99 which matches the bend 99 of the inner clamp member 58*a* which depends from top 57*a*. The upper end of center rib 71*a* is sandwiched between the vertical stretches 97 and the upper ends of outer ribs 59*a* are sandwiched between the bends 99.**

The concave sides **59*a*, gripped between the bent portions 99 of the upper eye 96, curve inwardly and outwardly in concave shape, their narrowest point being at the Z axis of the axis-crossing point 76*a*. Between the concave sides 59*a* is center rib 71*a* and the sides 59*a* are filled with rubber or plastic material 74*a*, all as in the preceding modification. Stretches 98 form the top boundaries for material 74*a* and portions 102 of bottom eyes 101** the bottom boundaries therefor.

Below the central portion of connector **56*a* are bottom eyes 101 each having a top 102 which forms a boundary for the lower end of the plastic material 74*a*. Top 102 is bent upwardly-downwardly at its outer edge in an outward bend 103 and at the opposite edge of top 102 is bent inwardly and downwardly in an inward bend 104. Below bend 104 the lower eye slants outwardly-downwardly in a stretch 106. The lower edges of concave sides 59*a* are gripped between outward bend 103 and vertical outer brace 107. The lower end of center rib 71*a* is gripped between the opposed inward bends 104 of the two eyes 101.**

Stretcher **62*a*, as shown in FIG. 8, is an elongated diamond shape. However, it will be understood that the shape may be similar to the outline of members 62 of FIG. 6 and 62*b* of FIG. 10. The upper edge of stretcher 62*a* is rigidified by peripheral rib 116 projecting rearwardly of the top edge of stretcher 62*a*.**

A U-shaped bracket 111 is attached to the back of the center of stretcher **62*a* by rivets 112 or other means. The lower ends of outer braces 107 overlap the parallel flanges 114 of bracket 111 and are connected thereto by rivets 113.**

The connector **56*a* of FIGS. 8 and 9 resembles in function the connector 56 of the preceding modification but is fabricated of metal and/or plastic rather than being molded of plastic. In other respects, the modification of FIGS. 8 and 9** resembles that of the preceding modification and the same reference numerals followed by the subscript *a* are used to designate corresponding parts.

What is claimed is:

1. A backpack frame comprising a rigid member of extended length adapted to extend along the back of the wearer having an upper portion, a middle portion below said upper portion, and a lower portion below said middle portion, said middle portion generally fitting between the shoulder blades and the waist of the wearer, a pair of shoulder straps, each said shoulder strap having an upper end and a lower end, upper end fastening means to attach each said upper end to said upper portion, lower end fastening means to attach each said lower end to said lower portion, a hip engaging belt to encircle the hips of the wearer, and a connector, said connector being vertically elongated, first means rigidly connecting the upper end of said connector to said middle portion, second means attaching the lower end of said connector to said belt, said connector having third means on its upper end adapted for cooperative engagement with said first means, a narrow portion below said third means, a horizontally elongated stretcher below said narrow portion shaped to fit behind the hips of the wearer and having fourth means for cooperative engagement with said second means, said stretcher being rigid relative to said narrow portion but resilient about a vertical axis to apply tension to said hip engaging means to maintain said stretcher out of contact with the back of the wearer, said narrow portion having at least two generally vertically extending ribs, said ribs being thin in a horizontal-transverse direction and being wide in a horizontal-longitudinal direction, whereby said narrow portion can flex about a vertical axis and also about a horizontal-longitudinal axis but resists rotation about a horizontal-transverse axis so that said stretcher does not move toward and away from the wearer in a horizontal-longitudinal direction.

2. A frame according to claim 1 in which said narrow ribs are arcuate in front elevation, curving inward toward each other to a narrowest area through which said horizontal longitudinal axis passes, said ribs being separated from each other at said narrowest area.

3. A frame according to claim 2 in which the space between said narrow ribs is substantially filled with a soft elastomeric substance which, under stress, biases said ribs to initial arcuate position.

4. A frame according to claim 3 which further comprises a vertical thin rib bisecting the space between said first-mentioned ribs, said elastomeric substance being divided on either side of said vertical rib.

5. A frame according to claim 1 in which said stretcher is wider in a vertical direction at the center than at either end and in side elevation slants downward-rearward.

6. A frame according to claim 1 in which said stretcher is molded integral with upper and narrow portions of said connector.

7. A frame according to claim 6 in which said second and fourth means are located near the outer horizontal extremities of said stretcher.

8. A frame according to claim 1 in which said first means comprises a horizontal-transverse pin through said upper end of said connector and said third means comprises clamp means to restrain rotation of said connector about the axis of said pin.

9. A frame according to claim 8 in which said middle portion of said frame is formed with a series of aligned vertically spaced apart holes each adapted to receive said pin to adjust the elevation of said connector relative to said frame.

10. A backpack frame according to claim 1 in which said upper portion is provided with a horizontal-transverse crossbar, said upper end fastening means for said shoulder straps being connected to said crossbar.

11. A backpack frame according to claim 10 in which the elevation of said crossbar relative to said upper portion is adjustable.

12. A backpack frame according to claim 10 in which said upper end fastening means are horizontally adjustable along said crossbar.

13. A backpack frame comprising an upper, middle and lower portion, said middle portion being of substantially lesser width measured in a horizontal-transverse direction than said upper portion and than said lower portion, so that in front elevation said frame has an hourglass shape, said middle portion being at about the level of the elbows of the wearer when the frame is worn by the user so as to eliminate interference of said frame with arm movement of the wearer, and a substantially vertical flexible connector attached at its upper end to said middle portion and having means at its lower end for attachment of said lower end to a belt around the waist of a wearer.

14. A backpack frame according to claim 13 in which in side elevation said middle portion is displaced rearward of said upper portion and said lower portion is displaced rearward of said middle portion.

15. A backpack frame according to claim 13 in which said frame comprises a single piece of tubing bent to form said upper, middle and lower portions with a single joint.

* * * * *